United States Patent [19]

Wrobel

[11] Patent Number: 4,737,673

[45] Date of Patent: Apr. 12, 1988

[54] BEARING ASSEMBLY FOR AN AXIALLY COMPACT MINIATURE MOTOR OR VENTILATOR

[75] Inventor: Günter Wrobel, Villingen, Fed. Rep. of Germany

[73] Assignee: Papst Motoren GmbH & Co. KG, St. Georgen, Fed. Rep. of Germany

[21] Appl. No.: 930,421

[22] Filed: Nov. 14, 1986

[30] Foreign Application Priority Data

Sep. 19, 1986 [DE] Fed. Rep. of Germany ..... 3631920

[51] Int. Cl.[4] ..... H02K 5/16

[52] U.S. Cl. ..... 310/90; 310/67 R; 384/295

[58] Field of Search ..... 310/42, 67 R, 90, 261, 310/87; 384/220, 295, 297, 425, 438

[56] References Cited

U.S. PATENT DOCUMENTS

| | | | |
|---|---|---|---|
| 499,012 | 6/1893 | Cooper | 384/297 |
| 3,387,153 | 6/1968 | Grad | 310/90 |
| 3,806,216 | 4/1974 | Orkin et al. | 384/297 |
| 4,217,508 | 8/1980 | Uzuka | 310/67 R |
| 4,612,468 | 9/1986 | Stürm et al. | 310/67 R |

FOREIGN PATENT DOCUMENTS

| | | | |
|---|---|---|---|
| 0100078 | 7/1983 | European Pat. Off. . | |
| 2016802 | 8/1971 | Fed. Rep. of Germany . | |
| 3417127 | 11/1985 | Fed. Rep. of Germany . | |
| 1127821 | 1/1966 | United Kingdom | 310/268 |

*Primary Examiner*—Patrick R. Salce
*Assistant Examiner*—D. L. Rebsch
*Attorney, Agent, or Firm*—Barnes & Thornburg

[57] ABSTRACT

A bearing assembly for an axially compact miniature motor or ventilator, wherein a sintered friction bearing unit (15) for the motor of a rotary shaft (1) of the drive motor (13) is clamped between a shoulder (6') of a bearing support tube (5) and another shoulder (7) of a closure element (8) cooperating with the bearing support tube (5).

20 Claims, 3 Drawing Sheets

BEARING ASSEMBLY FOR AN AXIALLY COMPACT MINIATURE MOTOR OR VENTILATOR

BACKGROUND AND SUMMARY OF THE INVENTION

The present invention relates to a bearing assembly, especially for an axially compact miniature motor or ventilator, comprising: a central drive motor mounted through a flange and a bearing support tube, and a rotor bottom secured to the rotor of the drive motor; a friction bearing unit for the (rotary) shaft of the drive motor; and a housing forming a flow passage.

In miniature motors or ventilators, ball bearings or friction bearings are used for rotatably mounting the shaft of the motor. For example, laid-open European application No. 0 100 078 describes an axial ventilator (or blower) which includes a pair of ball bearings for rotatably mounting the shaft of the drive motor, which shaft, in turn, is connected to ventilator blades through a rotor bottom (or head). Mounting of the shaft by means of such ball bearings offers the advantage of high stability of speed of rotation of the thus equipped axial ventilator.

Friction bearings for electric motors and specifically for ventilators are described, for example, in German Pat. No. 20 16 802, U.S. Pat. No. 3,387,153 and laid-open German patent appln. No. 34 17 127.

More particularly, German Pat. No. 20 16 802 shows a bearing assembly in which one annular groove each is provided in the wall of the bore (hole) of a bearing support section and in the peripheral surface of a bearing bush, which grooves are aligned with each other and have inserted therein a radially resilient locking or arresting member, the width of which provides for axial play or clearance between the bearing bush and the support section. However, it is relatively difficult to manufacture a bearing assembly of this type, since one groove each must be machined in both the support section and the bearing bush. This is undesirable from a production aspect because of the extra machining step required for forming these grooves.

Further, in the bearing assembly as disclosed in U.S. Pat. No. 3,387,153, the bearing bush likewise has grooves in its outer peripheral surface, which grooves receive O-rings for sealing the lubricant. In this conventional bearing assembly, the friction bearing unit proper is formed of two parts which are biased against a counter ring connected to the rotor by a spring ring attached to the end of the shaft. This conventional bearing assembly is expensive to manufacture because of the additional grooves formed in the two friction bearing parts. Further, assembling of this bearing assembly is difficult because of, the multi-piece construction of the friction bearing.

Finally, the miniature ventilator as disclosed in laid-open German patent appln. No. 34 17 127 employs a stepped sintered body, received in a mounting tube having end faces which correspond to the steps of the sintered body. The sintered body is secured at the steps of the mounting tube by an intermediate member for which a resilient spacer element may be used, if desired. In this conventional miniature ventilator, the shoulders of the sintered body must be precisely aligned in position with the steps of the mounting tube, and this arrangement also may involve problems in production.

Although sintered bearings are inferior with respect to stability of speed of rotation, they are preferable with respect to noise generation.

Thus, depending on the desired application, with otherwise identical structure, and motors or ventilators are provided, expediently, with sintered bearings or ball bearings. If high stability of speed of rotation is desired, ball bearings are preferable. On the other hand, when the motor or ventilator is desired to operate in a particularly noise-free manner, a sintered bearing is more expedient.

Even if a user normally does not replace the bearing means in a motor or ventilator, nevertheless, it would mean a significant advantage for the manufacturer if the bearing means of a motor or ventilator can be configured so that this motor or ventilator may be equipped with a ball bearing or alternatively with a friction bearing. Accordingly, a motor or ventilator being compatible for equipment with a friction bearing or a ball bearing would be highly beneficial.

Therefore, it is the object of the present invention to provide for an axially compact miniature motor or ventilator, a bearing assembly which permits the use of a friction bearing including a friction bearing unit that may be easily produced, and wherein said friction bearing may be replaced by a ball bearing without any problem.

In a bearing assembly for an axially compact miniature motor or ventilator having a central drive motor mounted through a flange, a bearing support tube, and a rotor of the drive motor with a friction bearing for the shaft of the drive motor, according to the invention, this object is solved in that the friction bearing unit is clamped between a first shoulder of the bearing support tube on the one hand, and a second shoulder of a closure element cooperating with the bearing support tube on the other hand.

Thus, in the bearing assembly according to the invention, the friction bearing unit is disposed, on the one hand, between a first shoulder of the bearing support tube, which shoulder may be formed, for example, by an inwardly protruding projection on the rotor bottom-side end of the bearing support tube, and, on the other hand, a second shoulder which acts upon the end of the friction bearing unit opposite from the rotor bottom and which comprises the closure element cooperating with the bearing support tube.

In a highly advantageous manner, the bearing assembly may be used, for example, in an especially axially compact miniature ventilator for cooling electrical components.

In this way the friction bearing unit does not require any grooves, and rings received in such grooves, for fixing within the miniature motor or ventilator, and, further, may be replaced by a ball bearing without any major modification. Instead of the friction bearing unit, there are provided between the two shoulders a pair of ball bearings separated from each other by e.g. a spacer sleeve.

In a further embodiment of the invention, the closure element is a bayonet-type closure element. This provides for particularly time-saving assembling of the bearing assembly. The bearing support tube, optionally a first rubber ring, a plastic sleeve, a second rubber ring and, then, the friction bearing unit which is thereafter clamped by means of the bayonet-type closure element between the shoulder of the latter and the shoulder of the bearing support tube are sequentially slid onto the shaft.

According to another embodiment of the invention, a sleeve, formed preferably of plastics material, is provided between the first shoulder and a rim of the friction bearing unit, which contacts or abuts the second shoulder. In addition, a rubber ring may be provided between the first shoulder and the sleeve, and between the sleeve and the rim.

Even without such rubber rings, an elastic mounting, and not a rigid press fit is present.

Furthermore, it is advantageous that between the first shoulder and a rim of the friction bearing unit, contacting the second shoulder, there is provided a sleeve formed of an elastic material, for example, rubber. In this way, the sintered body of the friction bearing unit may be formed thinner. This means that said sintered body may be press-shaped. In this way, it is possible to provide a recess in the contact surface of the shaft within the bore (hole) of the sintered body, whereby the contact surface area is reduced.

The sleeve formed of the elastic material may be clamped in the axial direction between the first shoulder and the rim. Preferably, the first shoulder comprises an inwardly extending radial thickened portion of the bearing support tube. In the axial direction, the sleeve formed of the elastic material may extend up to the end of the thickened portion directed away from the first shoulder, or beyond said end. In the radial direction, the sleeve formed of the elastic material is disposed between the bearing support tube and the friction bearing unit.

Also, according to another embodiment of the invention a further rubber ring and a plastic sleeve are provided between the first shoulder and a rim of the friction bearing unit, which rim contacts or abuts the second shoulder with the interposition of a rubber ring. Such a construction is preferable, especially when two separate ball bearings are installed instead of one double-row ball bearing.

Finally, it is also advantageous that a circuit board is connected to the bearing support tube through an insulating piece. This structure offers expedient facility for housing the necessary electrical components within the miniature ventilator.

These and other objects, feature, and advantages of the present invention will become more apparent from the following description when taken in connection with the accompanying drawings which show, for the purposes of illustration only, plural embodiments in accordance with the present invention, and wherein.

DETAILED DESCRIPTION OF THE DRAWINGS

Figure 1:
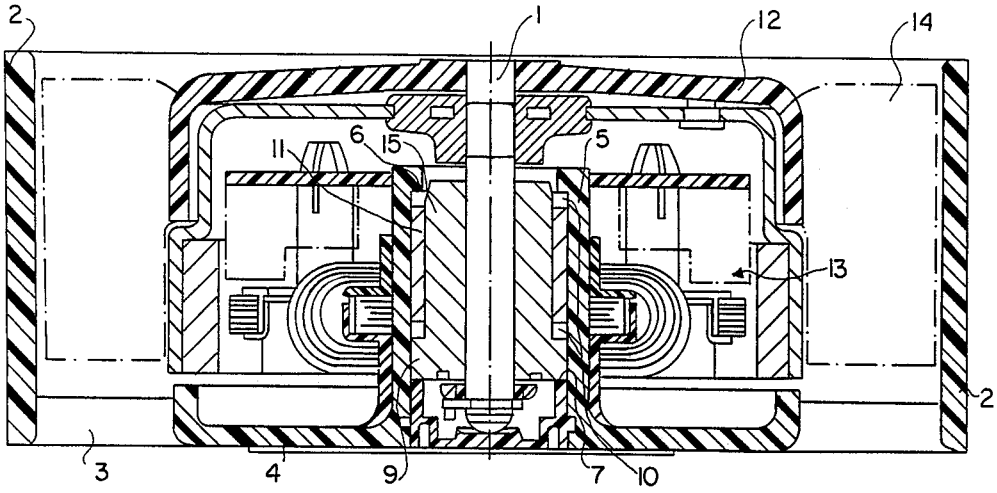
FIG. 1 shows a sectional view of a first exemplary embodiment of the bearing assembly for a miniature ventilator.

Referring now to the drawings wherein like reference numerals are used to designate like parts and more particularly to FIG. 1 a miniature ventilator comprising a (rotary) shaft 1, a central drive motor 13 mounted through a flange 4 and a bearing support tube 5, and a rotor bottom (impeller) 12 are secured to the shaft 1 and have ventilator blades 14 fitted thereon. The shaft 1 is mounted for rotation in a friction bearing unit 15 being clamped between a shoulder 6 of the bearing support tube 5 and a shoulder 7 of a bayonet-type closure element 8 fitted into the bearing support tube 5. Here, the friction bearing unit 15 is fixed or positioned between said two shoulders 6, 7 with a rim 9 by a pair of rubber rings 10 and a plastic sleeve 11.

In assembling the bearing assembly, first the bearing support tube 5 is slid over the shaft 1. Then, the rubber ring 10 adjoining the shoulder 6 of the bearing support tube 5 is inserted. Thereafter, the plastic sleeve 11 is fitted into the bearing support tube 5. Subsequently, the other rubber ring 10 is placed on the end of the plastic sleeve 11 within the bearing support tube 5. Finally, upon insertion of the friction bearing unit 15, the bayonet-type closure element 8 is joined (or locked) to the bearing support tube 5, whereby the mounting of the shaft 1 is completed.

In the embodiment according to FIG. 1, instead of the friction bearing unit 15, a ball bearing may easily be used; to this end, a double-row ball bearing is used expediently. Then, the ball bearing contacts its outer peripheral surface between shoulders 6, 7, so as to be fixed in its position. In this case, the rubber rings 10 and the plastic sleeve 11 are not required.

If necessary, the housing 2, a motor flange 4 and webs 3 connecting the housing 2 to the motor flange 4 may be formed integrally. Also, it is possible to press the ventilator blades 14 onto the outer peripheral surface of the rotor bottom or head (impeller) 12 by means of a ring (not shown).

Essential to the present invention is that the friction bearing unit 15 is fixed between a pair of shoulders 6, 7 of the bearing support tube 5 and the closure element 8 joined to the latter, such that it is not necessary to form a groove or grooves in the friction bearing unit 15.

Figure 2:
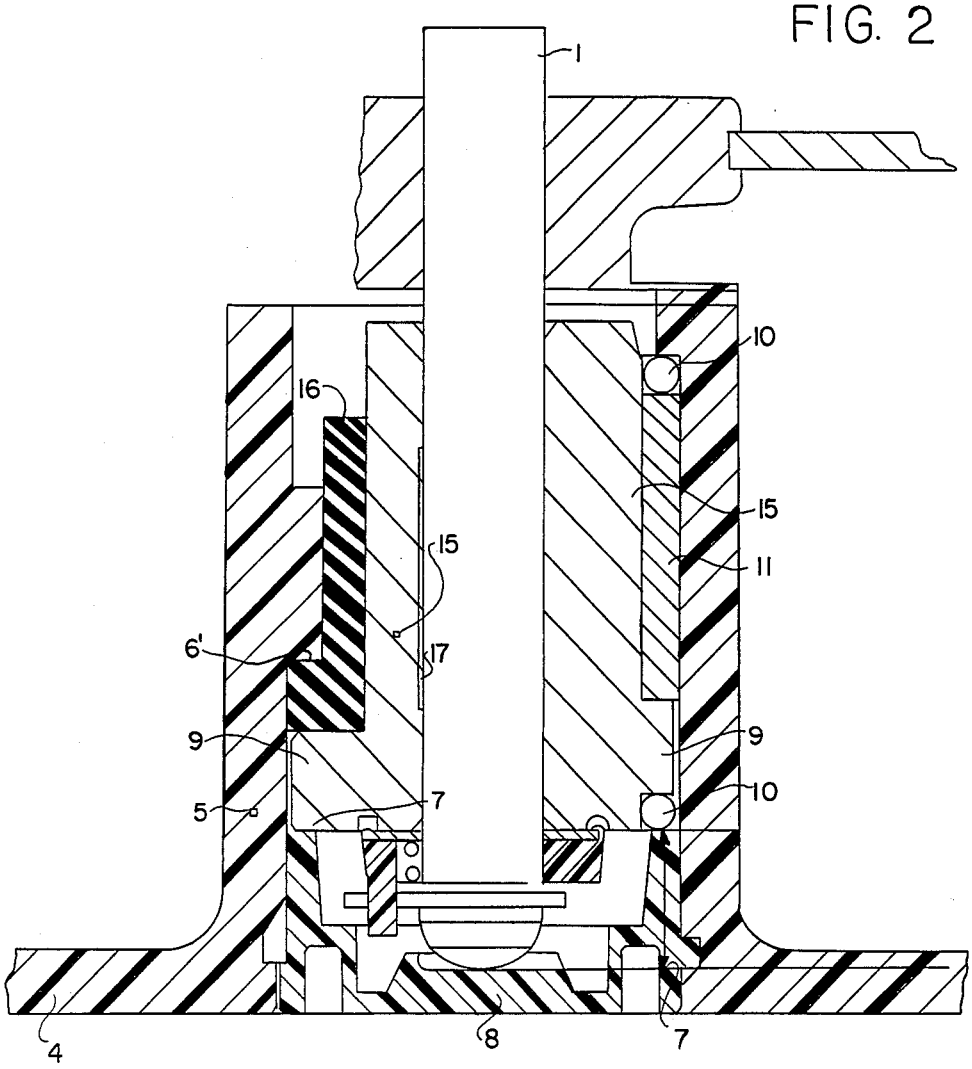
FIG. 2 shows in the right and left halves thereof, a sectional view of a second and a third, particularly advantageous exemplary embodiment, respectively, of the bearing assembly according to the invention.

FIG. 2 shows in the right hand half thereof a second embodiment of the invention which differs from the embodiment according to FIG. 1 substantially in that the rubber ring 10 (the lower one according to FIG. 2) is not provided between the plastic sleeve 11 and the rim 9 of the friction bearing unit 15. Rather, in this instance, this (lower) rubber ring 10 is positioned between the rim 9 and the abutment (shoulder) 7 of the closure element 8.

In a third embodiment of the invention, illustrated in the left hand half of FIG. 2, a sleeve 16, formed of e.g. rubber, is provided between shoulder 6' of the bearing support tube 5 and the rim 9 of the friction bearing unit 15. This means that the friction bearing unit 15 is clamped by means of sleeve 16 between the shoulder 6', formed by a thickened portion of the bearing support tube 5, and the shoulder 7 of the bayonet-type closure element 8. A different suitable elastic material other than rubber may be used for the sleeve 16.

Thanks to this sleeve 16, the friction bearing unit 15 may be formed to be thinner, e.g. with a wall thickness of the order of about 2 mm, such that it may be formed by press-shaping from a sintered body. In this way, it is readily possible to provide a recess 17 in the inner peripheral surface of the friction bearing unit 15, which recess greatly reduces the contact surface (area) between the friction bearing unit 15 and the shaft 1. When the friction bearing unit 15 has a greater wall thickness, it cannot be formed by press-shaping from a sintered body; in practice, this means that a recess reducing the contact surface area can be formed in the bore hole of the sintered body only with difficulty only.

Figure 3:
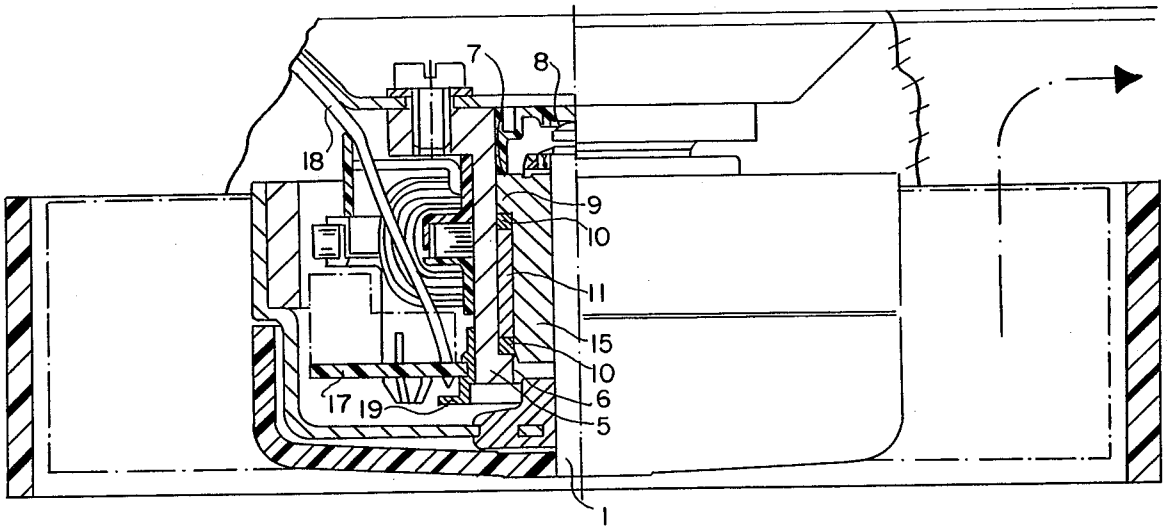
FIG. 3 is a sectional view of a fourth (exemplary) embodiment of the bearing assembly, including a (printed) wiring board connected to the bearing support tube.

FIG. 3 illustrates an embodiment of the invention which is greatly similar to the embodiment according to FIG. 1. In the embodiment according to FIG. 3, the friction bearing unit 15 is fixed (stationarily) between the shoulder 6 of the bearing support tube 5 and the shoulder 7 of the bayonet-type closure element 8 joined to the bearing support tube 5. Furthermore, in the embodiment of FIG. 3, there is illustrated a printed circuit board 17 having a lead 18. This circuit board 17 is connected to the bearing support tube 5 through an insulating sleeve 19.

Figure 4:
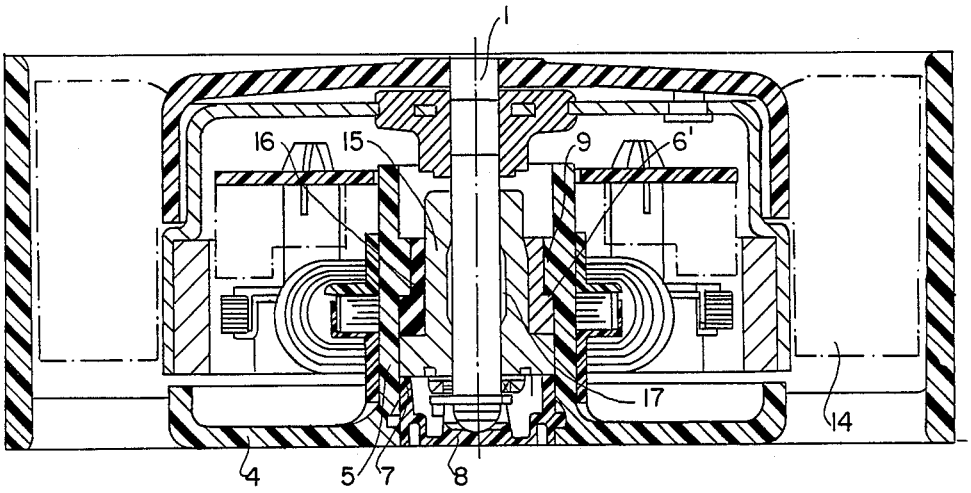
FIGS. 4 and 5 are each a sectional view of a fifth and a sixth embodiment, respectively, similar to the third embodiment.
Figure 5:
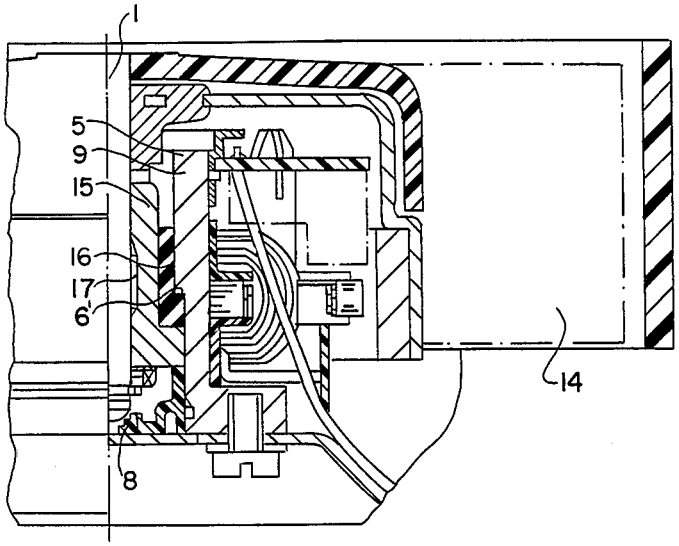

FIGS. 4 and 5 each illustrate a fifth and sixth embodiment similar to the third embodiment. Whereas in the third embodiment (see left half of FIG. 2) the sleeve 16 extends in the axial direction beyond the thickened portion of the bearing support tube 5, in the embodiment according to FIG. 4 the bearing support tube 5 and the sleeve 16 terminate to be flush with each other at the end opposite from the shoulder 6'. In the embodiment according to FIG. 5 (which is less suitable for ball bearings), the thickened portion (rim 9) of the bearing support tube 5 extends up to its end opposite (directed away) from the shoulder 6', whereby production is greatly facilitated.

Accordingly, in all of the above embodiments of the present invention, the sintered friction bearing unit 15 is fixed (stationarily) between the two shoulders 6, 7 of the bearing support tube 5 and of the bayonet-type closure element 8 joined to the latter, respectively. The friction bearing unit 15 is free from grooves or slots such that it may be produced in easy manner. Furthermore, the bearing assembly may be assembled easily. In the bearing assembly, the friction bearing unit—optionally in combination with the rubber rings and the plastic sleeve—may be replaced by a double-row ball bearing or even by a pair of ball bearings separated from each other by a spacer sleeve; this means that the bearing assembly may be manufactured to be compatible with friction bearings and ball bearings.

Of particular advantage is the configuration of the bearing assembly with the sleeve formed of an elastic (or resilient) material. Because of this sleeve, the wall thickness of the friction bearing unit may be reduced to such an extent that the sintered body may be prepared by press-shaping, and this reduces by means of a recess, the contact surface area between the friction bearing unit and the shaft.

While I have shown and described plural embodiments in accordance with the present invention, it is understood that the same is not limited thereto but is susceptible to numerous changes and modifications as known to one having ordinary skill in the art, and I therefore do not wish to be limited to the details shown and described herein, but intend to cover all such modifications as are encompassed by the scope of the appended claims.

I claim:

1. A bearing assembly for an axially compact miniature motor or ventilator, comprising:

a central drive motor mounted through a flange (4), a bearing support tube (5), and a rotor bottom (12) secured to the rotor (1) of the drive motor;

a friction bearing unit (15) for a shaft (1) of the drive motor (13); and wherein the friction bearing unit (15) is clampingly pressed between a first shoulder (6) of the bearing support tube (5) and a second shoulder (7) of a closure element (8) cooperating with the bearing support tube (5).

2. The bearing assembly according to claim 1, wherein the closure element (8) comprises a bayonet-type closure element.

3. The bearing assembly according to claim 1, wherein a sleeve (11), formed of plastics material, is provided between the first shoulder (6) and a rim (9) of the friction bearing unit (15), which contacts or abuts the second shoulder (7).

4. The bearing assembly according to claim 3, wherein a rubber ring means is provided between the first shoulder (6) and the sleeve (11), and between the sleeve (11) and the rim (9), respectively.

5. The bearing assembly according to claim 1, wherein a sleeve (16), formed of an elastic material, is disposed between the first shoulder (6') and a rim (9) of the friction bearing unit (15), which contacts the second shoulder (7).

6. The bearing assembly according to claim 1, wherein a further rubber ring (10) and a plastic sleeve (11) are provided between the first shoulder (6') and the rim (9) of the friction bearing unit (15), which rim (9) contacts or abuts the second shoulder (7) with the interposition of a rubber ring (10).

7. The bearing assembly according to claim 5, wherein the friction bearing unit (15) has a contact surface area reduced by a recess (17).

8. The bearing assembly according to claim 1 wherein a printed circuit board (19) is connected to the bearing support tube (5) through an insulating piece (19).

9. The bearing assembly according to claim 1 wherein the friction bearing unit (15) comprises a sintered bearing.

10. The bearing assembly according to claim 5, wherein the elastic material (16) is rubber.

11. The bearing assembly according to claim 5, wherein the sleeve (16), formed of the elastic material, is axially clamped between the first shoulder (6') and the rim (9).

12. The bearing assembly according to claim 5, wherein the first shoulder (6, 6') is formed by an inwardly extending radial thickened portion of the bearing support tube (5).

13. The bearing assembly according to claim 5, wherein the sleeve (16), formed of the elastic material, extends beyond the end of a thickened portion opposite from the first shoulder (6'), in the axial direction.

14. The bearing assembly according to claim 5, wherein the sleeve (16), formed of the elastic material, extends up to the end of the thickened portion opposite from the first shoulder (6'), in the axial direction.

15. The bearing assembly according to claim 5 wherein the sleeve (16), formed of the elastic material, is provided in the radial direction between the bearing support tube (5) and the friction bearing unit.

16. The bearing assembly according to claim 2, wherein a sleeve (11), formed preferably of plastics material, is provided between the first shoulder (6) and a rim (9) of the friction bearing unit (15), which contacts or abuts the second shoulder (7).

17. The bearing assembly according to claim 2, wherein the friction bearing unit (15) comprises a sintered bearing.

18. The bearing assembly according to claim 3, wherein the friction bearing unit (15) comprises a sintered bearing.

19. The bearing assembly according to claim 4, wherein the friction bearing unit (15) comprises a sintered bearing.

20. The bearing assembly according to claim 5, wherein the friction bearing unit (15) comprises a sintered bearing.

* * * * *